United States Patent [19]

Terashima

[11] 4,292,925

[45] Oct. 6, 1981

[54] TONER CONCENTRATION DETECTING APPARATUS

[75] Inventor: Isamu Terashima, Ibaraki, Japan

[73] Assignee: Hitachi, Ltd., Tokyo, Japan

[21] Appl. No.: 84,455

[22] Filed: Oct. 12, 1979

[30] Foreign Application Priority Data

Oct. 18, 1978 [JP] Japan ..... 53-127381

[51] Int. Cl.[3] ..... G03G 15/09

[52] U.S. Cl. ..... 118/690; 118/663

[58] Field of Search ..... 118/689, 690, 688, 691, 118/663

[56] References Cited

U.S. PATENT DOCUMENTS 3,999,687 12/1976 Baer et al. ..... 118/689

4,131,081 12/1978 Terashima ..... 118/689

*Primary Examiner*—Evan K. Lawrence

*Attorney, Agent, or Firm*—Craig and Antonelli

[57] ABSTRACT

A toner concentration detecting apparatus is disclosed wherein developing powder including magnetic carrier and pigmented toner is carried on a magnet roller and transported thereby to a surface of a photosensitive drum, and after development a portion of the developing powder is removed off the surface of the magnet roller and passed through a hollow body containing a detection coil to determine a concentration of the toner in the developing powder based on a magnitude of an inductance of the detection coil. A flow condition of the developing powder is at the same time determined by detecting a rippled voltage induced by the detection coil. Accuracy of detection is enhanced by an electric circuit for pulsating the rippled voltage and counting the number of pulses produced thereby. The flow of the developing powder is accelerated by a vibrator mounted on the hollow body responding to an output signal of the electric signal if the flow of developer powder stops. If the toner concentration falls below a predetermined range, a toner supply means supplies toner to the chamber. The toner is supplied only when the developing powder is flowing through the hollow body.

18 Claims, 6 Drawing Figures

TONER CONCENTRATION DETECTING APPARATUS

BACKGROUND OF THE INVENTION

The present invention relates to an apparatus for detecting a toner concentration (composition ratio) in developing powder for an electrostatic printing machine which uses the developing powder comprising a mixture of magnetic carrier and toner, especially for detecting a flow condition of the developing powder.

In an apparatus in which an electrostatic latent image is developed by developing powder comprising the mixture of the magnetic carrier and the toner, only the toner is consumed in the developing process but the magnetic carrier is not substantially consumed and it is maintained for reuse. As a result, as the developing powder is used repeatedly, a toner concentration of the developing powder decreases gradually. In order to maintain a high quality of the developed image, however, the toner concentration should be maintained at a fixed value or in a given range.

For this reason, an apparatus for detecting a toner concentration of developing powder has been proposed which comprises a transport means for transporting the developing powder stored in a chamber while magnetically attracting the developing powder, a hollow body, a guide means for diverting a portion of the developing powder from the transport means and directing the diverted developing powder to the hollow body and a response means for responding to a permeability of the developing powder passing through the hollow body, an example of which is U.S. Pat. No. 4,131,081.

In the conventional apparatus, however, the flow of the developing powder in the hollow body is obstructed or stopped when the balance of atmospheric electricity between the developing powders is lost due to high air humidity and change of the flow condition based on the change of the toner concentration.

When the developing powder does not flow, the toner concentration of the developing powder detected by the apparatus is always same and does not respond to that of the developing powder actually developing an electrostatic latent image.

In such case, toner is not supplied to the developing apparatus even though the toner concentration of the developing powder decreases.

SUMMARY OF THE INVENTION

An object of the present invention is to provide a toner concentration detecting apparatus capable of detecting not only a toner concentration but also a flow condition of the developing powder with a high reliability.

An another object of the present invention is to provide a toner concentration detecting apparatus capable of preventing a flow of the developing powder passing therethrough from being stopped.

A still another object of the present invention is to provide a toner concentration detecting apparatus capable of controlling the amount of the toner to be supplied in response to the flow condition of the developing powder and the toner concentration.

An electric output signal of the toner concentration detecting apparatus according to the present invention includes a ripple signal only when the developing powder flows. A flow condition of the developing powder is determined by detecting the ripple signal produced by the flow of the developing powder.

DETAILED DESCRIPTION OF THE PREFERRED EMBODIMENT

Figure 1:
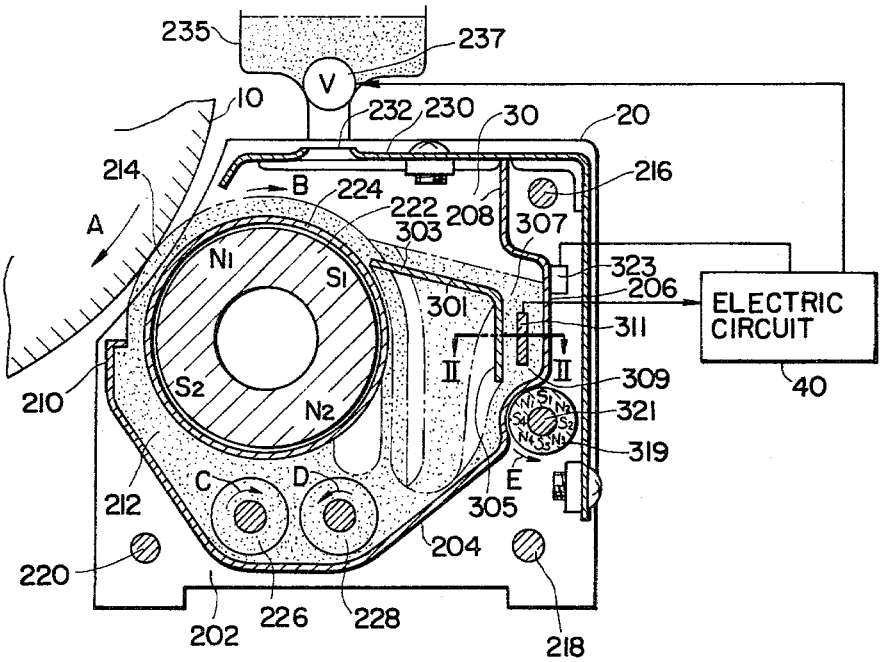
FIG. 1 is a longitudinal sectional view of major sections of a developing apparatus incorporating detecting apparatus of the present invention.
Figure 2:
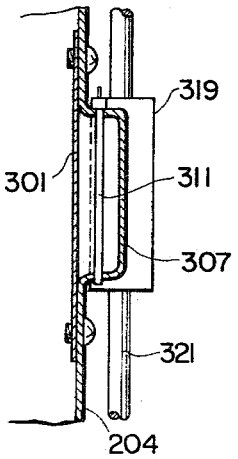
FIG. 2 is a II—II sectional view of FIG. 1.

Referring to FIGS. 1 and 2, a toner concentration detecting apparatus 30 of the present invention is incorporated into a developing apparatus 20 which uses developing powder. An electric latent image is formed by a well-known electric photography technology on a surface of a photosensitive drum 10.

The developing apparatus 20 has a pair of side plates 202, a case 204 and spacers 206, 208 and 210 which define a chamber to receive developing powder 212 at the bottom portion thereof. A permanent magnet roll 222 is supported between the pair of side plates 202 and circumferentially magnetized. A sleeve 224 of non-magnetic material is arranged concentrically to the permanent magnet 222 and rotatably supported. Blending screws 226 and 228 are rotatably supported between the pair of side plates 202 for blending and electrifying the developing powder 212. The photosensitive drum 10, sleeve 224 and the blending screws 226 and 228 are linked by an external driving mechanism, not shown, such that they are synchronously driven in the direction of arrows A, B, C and D.

Figure 3:
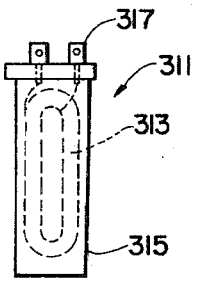
FIG. 3 is a side view of a detecting coil unit for detecting a toner concentration and a flow condition of developing powder.

In the toner concentration detecting apparatus 30, a developing powder guide plate 301 comprises a slightly inclined portion 303 and a vertical portion 305 and is made of non-magnetic material. One end of the slightly inclined portion 303 is arranged to face the outer periphery of the sleeve 224 with a slight clearance therebetween to divert a portion of the developing powder transported along the outer periphery of the sleeve 224. The vertical portion 305 is arranged to form a hollow body 307 having a path 309 for the diverted developing powder together with a hollow portion 206 formed at the vertical portion of the case 204 so as to be convex outwardly. A detection coil unit 311 detects a toner concentration and a flow condition of the diverted developing powder passing through the hollow body 307. The detection coil unit 311 is arranged in the path 307 so that the diverted developing powder flows therealong and comprises a detection coil 313 wound in a case 315 made of mold resin and having a pair of output terminals 317 provided at the upper portion thereof as shown in FIG. 3. The detection coil unit 311 is electrically connected with an electric circuit 40 which will be described hereinafter in detail. A small permanent magnet roll 319 mounted on a shaft 321 is positioned to the downstream side of the hollow body 307 for magnetizing the developing powder 212 downstream of the hollow body 307 to stabilize the flow of the developing powder 212 passing through the hollow body 307 and driven together with the sleeve 224 by an external mechanism, not shown, in the direction of an arrow E for forwarding the developing powder 212 from the path 309 into the sleeve 224 and the blending screws 226 and 228 in the chamber. A vibrator 323 is mounted at the upstream side of the hollow body 307 and connected electrically with the electric circuit 40 so as to accelerate the flow of the developing powder 212 in response to an electric signal produced in the electric circuit 40 when the flow of the developing powder 212 in the path 309 stops.

A cover 230 having a toner supply opening 232 therein is fixedly mounted at one end portion 208 of the case 204 for preventing the scatter of the developing powder 212. A toner supply assembly 235 is mounted on the developing apparatus 20 and has a valve assembly 237 therein electrically connected with the electric circuit 40 for supplying toner to the developing apparatus 20 in response to an electric signal produced in the electric circuit 40. The other end portion 210 of the case 204 forms a portion for restricting the thickness of the developing powder layer transported by the sleeve 224 by being deposited thereon by magnetic attraction force of the magnet 222, to a fixed thickness such that the outer surface of the developing powder layer slightly rubs the surface of the photosensitive drum 10.

As the photosensitive drum 10 rotates in the direction of an arrow A, the sleeve 224 and the blending screws 226 and 228 rotate in the directions of arrows B,C and D, respectively. On the other hand, lines of magnetic force of the permanent magnet 222 are produced between magnet poles $S_1$, $S_2$, $N_1$, $N_2$. As a result, the magnetic powder 212 is strongly attracted onto the sleeve 224 at the area between magnet poles $S_1$-$N_1$-$S_2$-$N_2$ forming magnetic brushes 214. As the sleeve 224 rotates in the direction of the arrow B, the developing powder layer also moves in the same direction so that the outer periphery of the layer contacts the photosensitive drum 10 to develop a latent image thereof. Thereafter, when the developing powder layer reaches immediately above the magnet pole $S_1$, it is partially diverted from the surface of the sleeve 224 by the guide plate 301 and the diverted developing powder is transported on the guide plate 301 toward the path 309 of the hollow body 307.

The diverted developing powder flows into the path 309 formed between the vertical portion 303 of the guide plate 301 and the hollow portion 206 of the case 204 and passes through along the detection coil unit 311 arranged in the middle of the path 309 to detect the toner concentration and the flow condition of the developing powder 212.

The detection coil unit 311 supplies electrical signals concerning the toner concentration and the flow condition of the developing powder to the electric circuit 40.

The vibrator 323 or valve assembly 237 of the toner supply assembly 235 is operated in response to the electrical signals of the electric circuit 40 based on the output signal of the detection coil unit 311, details of which will be described hereinafter.

The developing powder 212 passing through the path 309 is magnetized by the small magnet roller 319 at the downstream side of the hollow body 307 to suppress the spontaneous flux of the developing powder and drawn out smoothly by means of the rotation of the small magnet roller 319 at a predetermined speed.

The small magnet roller 319 is rotated such that the amount of the developing powder 212 drawn out is less than that of the developing powder transported on the guide plate 301 toward the entrance of the path 309, whereby the path 309 is filled with the developing powder and the amount of the developing powder acting on the detection coil unit 311 is stabilized. At the entrance of the path 309 the developing powder 212 overflows. The developing powder 212 drawn out from the path 309 and overflowing at the entrance of the path 309 is reused after being blended by the blending screws 226 and 228 in the chamber.

Figure 4:
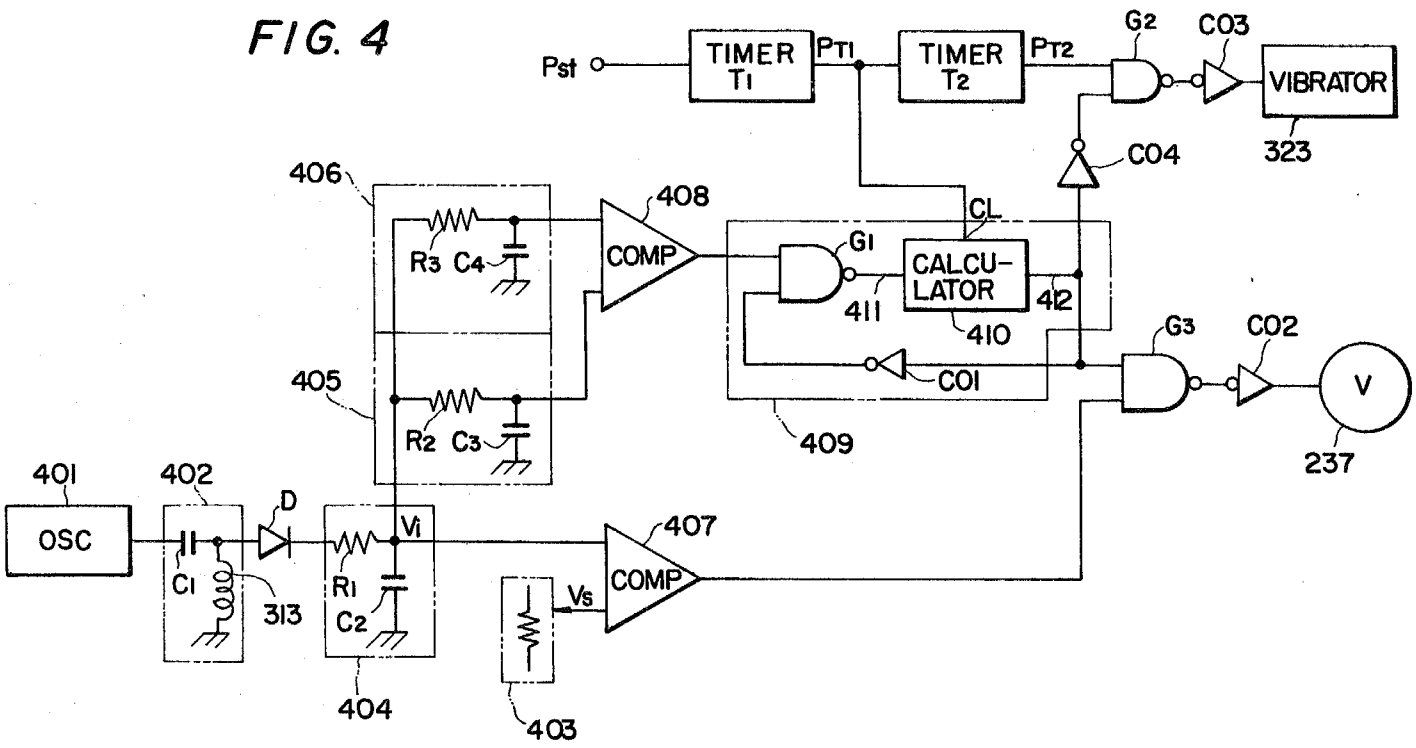
FIG. 4 is an electric circuit for detecting apparatus of the present invention.

A preferred embodiment of the electric circuit 40 for the detecting apparatus 30 according to the present invention is shown in FIG. 4.

Figure 5:
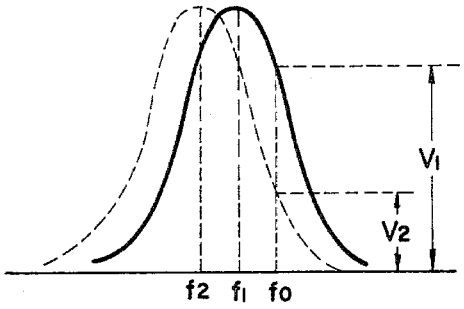
FIG. 5 shows a characteristic curve of voltage induced at the detecting coil unit.

A series resonance circuit 402 comprising the detection coil 313 of the detection coil unit 311 shown in FIG. 3 and a capacitor $C_1$ is connected with an oscillator 401 which is designed to oscillate at a frequency of $f_o$ shown in FIG. 5. The reasonance circuit 402 is designed such that the upper and lower limits of the toner concentration of the developing powder acting on the detection coil 311 in a preferrable condition in the path 309 respond to the resonance frequency of $f_1$ and $f_2$, respectively, at which the voltages of $V_1$ and $V_2$ shown in FIG. 5 are induced on the detection coil 313. The resonance circuit 402 is, on the other hand, connected with a first filter circuit 404 comprising a resistor $R_1$ and a capacitor $C_2$ over a diode D which rectifies a terminal voltage across the detection coil 313.

Figure 6:
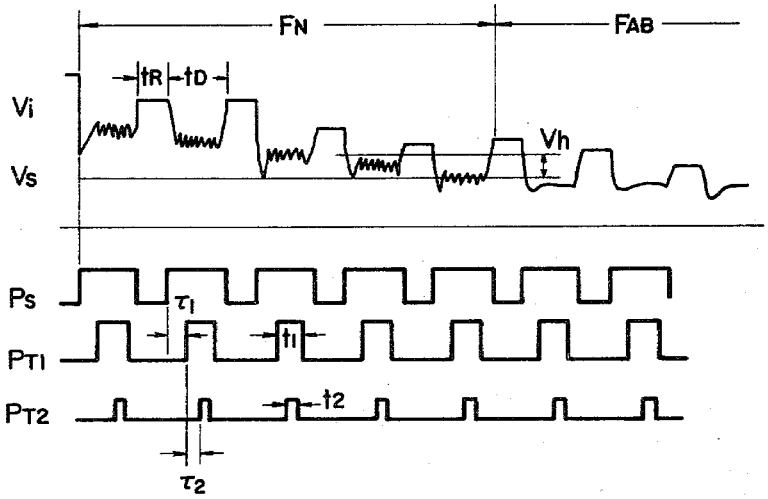
FIG. 6 shows an electric signal produced in an electric circuit in response to an output signal of the detection coil unit.

As shown in FIG. 6 a terminal voltage $V_i$ across the capacitor $C_2$ in the filter circuit 404 is flat and high in the range $t_R$ in which the developing apparatus 20 stops and the terminal voltage $V_i$ is a slight low and rippled in the range $t_D$ in which the developing apparatus 20 operates and the developing powder 212 passes through the path 309. The voltage $V_i$ across the capacitor $C_2$ tends to decrease in accordance with the consumption of toner and the decrease of the toner concentration.

The range $F_N$ shown in FIG. 6 shows a normal flow condition of the developing powder passing through the path 309 and the range $F_{AB}$ shows an abnormal flow condition of the developing powder due to the stop of the flow of the developing powder in the path 309. As shown in FIG. 6 in the case of the abnormal flow condition of the developing powder, the voltage across the capacitor $C_2$ is not rippled, even though the developing apparatus 20 is in a condition of operation.

The first filter circuit 404 is connected with a first comparator 407 on one hand and with a second comparator 408 over second and third filter circuits 405 and 406, respectively, on the other hand. The first comparator 407 compares the terminal voltage $V_i$ across the capacitor $C_2$ with a comparative voltage $V_s$ supplied from a basic voltage source 403 and is provided with hysteresis $V_h$ not to respond to the rippled voltage $V_i$. The comparative voltage $V_s$ responds the voltage $V_2$ across the capacitor $C_1$ appearing in the resonance circuit 402 at the lower limit of the toner concentration. An output terminal of the first comparator 407 is connected with one input terminal of a NAND gate $G_3$. The second filter circuit 405 comprising a resistor $R_2$ and a capacitor $C_3$ smoothes the rippled voltage $V_i$ across the capacitor $C_2$ in the first filter circuit 404 and supplies the smoothed voltage as a comparative voltage to the second comparator 408. The third filter circuit 406 comprising a resistor $R_3$ and a capacitor $C_4$ supplies the ripple voltage $V_i$ to the second comparator 408 at which the rippled voltage is pulsated. An output terminal of the second comparator 408 is connected with a counting circuit 409 for counting pulses produced at the secondary comparator 408. The counting circuit 409 comprises a NAND gate $G_1$, a counter 410 and an inverter C01. One of the input terminals of the NAND gate $G_1$ is connected with the output terminal of the second comparator 408 and the other is connected with an output terminal 412 of the counter 410 and the other input terminal of the NAND gate $G_3$ over the inverter C01.

A process signal terminal $P_{st}$ is connected with a timer $T_1$ for producing a pulse $P_{T1}$ of time duration $t_1$ at a passage of time $\tau_1$ after being actuated by a process signal $P_s$ as shown in FIG. 6. An output terminal of the timer $T_1$ is connected with an input terminal of a timer $T_2$ and a control terminal of the counter 410. The timer $T_2$ produces a pulse $P_{T2}$ of time duration $t_2$ at a passage of time $\tau_2$ after being actuated by the output signal of the timer $T_1$ as shown in FIG. 6. One input terminal of a NAND gate $G_2$ is connected with an output terminal of the timer $T_2$ and the other is connected with the output terminal 412 of the counter 410 over an inverter C04. An output terminal of the NAND gate $G_2$ is connected with the vibrator 323 over an inverter C03. The output terminal of the NAND gate $G_3$ is connected with the value assembly 237 arranged in the toner supply assembly 235 over an inverter C02.

When the process signal $P_s$ is supplied to the process signal terminal $P_{st}$, the developing apparatus 20 operates and the timer $T_1$ produces the pulse $P_{T1}$ at a passage of time $\tau_1$ after being actuated by the process signal $P_s$. The pulse $P_{T1}$ is supplied to the control terminal C1 of the counter 410. The counter 410 is set in a condition for counting the number of pulses by the rising signal of the pulse $P_{T1}$ as shown in FIG. 6.

When the developing apparatus 20 operates, the developing powder 212 passes through the path 309 and the detection coil unit 311 applies a detection signal concerning the toner concentration and the flow condition of the developing powder to the first filter circuit 404 over the diode D. The terminal voltage $V_i$ across the capacitor $C_2$ corresponding to the detection signal of the detection coil unit 311 decreases and is rippled while the developing powder 212 passes through the path 309 as shown in FIG. 6. The delay time $\tau_1$ of the timer $T_1$ is set such that the transitional phenomenon occurs therewithin. The rippled voltage $V_i$ is smoothed in the filter circuit 405 and supplied to the second comparator 408 as a comparative voltage. The rippled voltage $V_i$ is simultaneously supplied to the second comparator 408 over the third filter circuit 406 and pulsated at the second comparator 408. The pulsated signal at the comparator 408 is supplied to the counter 410 over the NAND gate $G_1$ and the number of pulses is counted. The counter 410 is set such that the output signal at the output terminal 412 of the counter 410 is produced, when the predetermined number of pulses produced in the normal flow condition of the developing powder 212 during the delay time $\tau_2$ of the timer $T_2$ is supplied to the input terminal 411 of the counter 410. The counter 410 produces a pulse at the output terminal 412 when a predetermined number of pulses are input at the input terminal 411. The output signal at the output terminal 412 is fed back to the input terminal of the NAND gate $G_1$ over the inverter C01 in order to prevent further input signal from being input to the input terminal of the NAND gate $G_1$.

When the developing powder flows normally in the path 309 as shown in the range $F_N$ of FIG. 6, the output signal of the counter 410 indicate "1" and the output signal of the inverter C04, accordingly, indicates "0". Then, the output signal of the NAND gate $G_2$ indicates "1" and the output signal of the inverter C03 indicates "0". Under such condition the vibrator 323 connected with the inverter C03 does not operate.

To the contrary, when the developing powder 212 does not pass through the path 309, the ripple of the voltage $V_i$ does disappear as shown in the range $F_{AB}$ of FIG. 6. Then, the output signal at the output terminal 412 of the counter 410 indicates "0" and the state "0" is kept. Accordingly, when the pulse $P_{T2}$ is supplied from the timer $T_2$ to the NAND gate $G_2$, the output signal $S_A$ of the inverter C03 indicates "1", which cause the vibrator 323 to operate. The hollow body 307 is vibrated by means of the vibrator 323 and the developing powder 212 in the path 309 is accelerated to flow. The output signal $S_A$ is available for operating a buzzer not shown.

While, the terminal voltage $V_i$ across the capacitor $C_2$ is compared with the comparative voltage $V_S$ settled at the first comparator 407. When the toner concentration of the developing powder 212 is within the predetermined range, the output signal of the first comparator 407 indicates "0". Accordingly, the output signal of the NAND gate $G_3$ indicates "1" and the output signal $S_B$ of the inverter C02 indicates "0".

However, when the toner concentration of the developing powder 212 is lower than the predetermined range, the output signal of the first comparator 407 indicates "1". In such case, when the developing powder 212 flows normally in the path 309 and the counter 410 indicates "1" at the output terminal 412, the NAND gate $G_3$ indicates "0" and the inverter C02 indicates "1", thereby the valve assembly 237 of the toner supply assembly 235 is operated to supply the developing powder 212.

When the developing powder 212 does not flow normally in the path 309, the output signal at the output terminal 412 of the counter 410 indicates "0" and the state "0" is kept. Then, the inverter C02, accordingly, outputs "0", thereby the valve assembly 237 of the toner supply assembly 235 is not operated until the developing powder 212 in the path 309 begins to flow normally.

I claim:

1. An apparatus for detecting a toner concentration of developing powder comprising:

a chamber for storing the developing powder therein;

means for transporting the developing powder to a photosensitive member to develop a latent image;

a hollow body having an inlet and outlet for passage of developing powder through said hollow body;

means for diverting a portion of the developing powder from said transporting means and directing the diverted portion of the developing powder to said hollow body;

detecting means for detecting the toner concentration of the developing powder within said hollow body and for detecting whether the developing powder is passing through said hollow body.

2. An apparatus for detecting toner concentration according to claim 1, wherein said detecting means is arranged in said hollow body so that the diverted developing powder flows therealong.

3. An apparatus for detecting a toner concentration according to claim 1, further including electric circuit means, means for passing a signal from said detecting means to said electric circuit means, flow accelerating means provided upstream of said hollow body to accelerate the flow of the developing powder, and means for transmitting a signal from said electric circuit means to said flow accelerating means to accelerate the flow of developing powder in response to said detecting means detecting that the developing powder is not passing through said hollow body.

4. An apparatus for detecting a toner concentration according to claim 1 wherein means for producing a stable flow path of the developing powder in said hollow body is positioned downstream of said hollow body to stabilize the flow of the developing powder passing through said hollow body.

5. An apparatus for detecting a toner concentration according to claim 2, wherein said developing powder contains a magnetic component, and wherein an electric circuit is electrically connected with said detecting means, said electric circuit being adapted to respond to an electric signal produced by said detecting means in detecting whether the developing powder is passing through said hollow body.

6. An apparatus for detecting a toner concentration according to claim 5, wherein said electric circuit includes means for providing a rippled voltage when said detecting means detects that developing powder is passing through said hollow body and for providing a non-rippled voltage when said detecting means detects that the developing powder is not passing through said hollow body.

7. An apparatus for detecting a toner concentration according to claim 6, wherein said electric circuit comprises means for pulsating the rippled voltage produced by said means for providing a rippled voltage when said detecting means detects that developing powder is passing through said hollow body and for providing a non-rippled voltage when said detecting means detects that the developing powder is not passing through said hollow body and means for counting the number of pulses produced by said pulsating means.

8. An apparatus for detecting a toner concentration according to claim 4, wherein the developing powder contains a magnetic component, said apparatus further including electric circuit means, means for passing a signal from said detecting means to said electric circuit means, and flow accelerating means electrically connected with said detecting means through said electric circuit means to accelerate the flow of developing powder in response to said detecting means detecting that the developing powder is not passing through the hollow body.

9. An apparatus for detecting a toner concentration of developing powder comprising a mixture of magnetic carrier and toner comprising:

a chamber for storing the developing powder;

means for transporting the developing powder stored in said chamber while magnetically attracting the developing powder;

a hollow body having an inlet and outlet for passage of developing powder through said hollow body;

means for diverting a portion of the developing powder from said transporting means and directing the diverted portion of the developing powder to said hollow body;

means for producing a magnetic path positioned downstream of said hollow body for magnetizing the developing powder downstream of said hollow body to stabilize the flow of the developing powder passing through said hollow body;

detecting means for indicating the toner concentration of the developing powder passing through said hollow body and for indicating whether the developing powder is passing through said hollow body, said detecting means including means for providing detecting signals indicating the toner concentration of the developing powder passing through said hollow body and indicating whether the developing powder is passing through said hollow body; and an electric circuit including means for producing electric output signals in response to said detecting signals.

10. A apparatus for detecting a toner concentration according to claim 9, wherein said detecting means is arranged in said hollow body so that the diverted developing powder flows therealong.

11. An apparatus for detecting a toner concentration according to claim 9, wherein one of the detecting signals indicates that the developing powder is not passing through said hollow body, and further including flow accelerating means provided upstream of said hollow body, said flow accelerating means being electrically connected to said electric circuit to accelerate the flow of developing powder in response to the electric output signal responsive to the detecting signal indicating that the developing powder is not passing through said hollow body.

12. An apparatus for detecting a toner concentration according to claim 9, wherein said detecting signals indicate that the toner concentration of the developing powder passing through the hollow body is lower than a pre-determined range and that the powder is passing through the hollow body, and further including toner supply means electrically connected to said electric circuit, said toner supply means supplying toner to the chamber in response to the electric output signals responsive to said detecting signals indicating that the toner concentration of the developing powder passing through said hollow body is lower than a predetermined range and indicating that the developing powder is passing through the hollow body.

13. An apparatus for detecting a toner concentration according to claim 11, wherein said electric circuit includes means for producing a rippled voltage when developing powder flows through the hollow body and for producing a non-rippled voltage when no developing powder flows through the hollow body, and wherein said flow accelerating means accelerate the developing powder flow through said hollow body when a non-rippled voltage is produced by the producing means.

14. An apparatus for detecting a toner concentration according to claim 12, wherein the electric circuit includes means for producing a rippled voltage when developing powder flows through the hollow body and for producing a non-rippled voltage when no developing powder flows through the hollow body, and wherein said toner supply means is responsive to said electric output signals to supply toner to the chamber when the toner concentration is indicated by said detecting means to be lower than a predetermined range and when a rippled voltage is produced by the producing means.

15. An apparatus for detecting a toner concentration according to claim 13 or 14, wherein said electric circuit further comprises means for pulsating the rippled voltage produced by the producing means to produce a pulse signal and means for counting pulses produced by said pulsating means.

16. In an electric photograph machine wherein developing powder comprising magnetic carrier and toner is magnetically attracted on a surface of a non-magnetic sleeve which rotates around a permanent magnet to transport the developing powder to develop a latent image, a toner concentration detecting apparatus comprising:

a non-magnetic hollow body having inlet and outlet means for passage of developing powder through the hollow body;

a detection coil unit arranged in the middle of said hollow body for detecting a toner concentration and for detecting whether the developing powder is passing through said hollow body;

a guide plate for diverting a portion of the developing powder on an outer periphery of the sleeve at an area downstream of a developing station and directing the diverted developing powder toward said hollow body;

a small magnetic roll arranged at the downstream side of said hollow body for magnetizing the developing powder downstream of said hollow body to stabilize the flow of the developing powder passing through said hollow body;

an electric circuit responsive to an inductance of said detection coil unit to provide output signals indicating whether the toner concentration of said developing powder in said hollow body is lower than a pre-determined range and indicating whether the developing powder is passing through said hollow body;

a vibrator arranged upstream of said hollow body and connected to said electric circuit, said vibrator acting to accelerate the flow of the developing powder in response to the output signal produced by said electric circuit indicating that the developing powder is not passing through said hollow body; and a toner supply assembly connected to said electric circuit for supplying the toner to the machine selectively in response to the output signals produced by said electric circuit indicating that the toner concentration of said developing powder in said hollow body is lower than a pre-determined range and indicating that the developing powder is passing through said hollow body.

17. A toner concentration detecting apparatus according to claim 16, wherein said guide plate comprises a slightly inclined portion and a vertical portion, one end of the slightly inclined portion is arranged to face the outer periphery of the sleeve with a slight clearance therebetween.

18. A toner concentration detecting apparatus according to claim 16, wherein said electric circuit includes means for producing a rippled voltage when developing powder is detected as passing through said hollow body, with said detection coil unit being electrically connected with said means for producing a rippled voltage, and wherein said electric circuit further comprises a first electric circuit including a first comparator for comparing said rippled voltage with a predetermined comparative voltage and a second electric circuit including a second comparator for pulsating said rippled voltage, a counting circuit for counting the number of pulses produced by the second comparator and a gate means for selecting an output signal of the first comparator in response to an output signal of the counting circuit.

* * * * *